United States Patent [19]

Roberts

[11] 4,311,099

[45] Jan. 19, 1982

[54] LAP TRAY

[76] Inventor: Judith Roberts, 2 Fox Hollow Ridings Ct., Northport, N.Y. 11768

[21] Appl. No.: 144,183

[22] Filed: Apr. 28, 1980

[51] Int. Cl.[3] ..... A47B 5/04; A47B 3/08; A47C 7/62

[52] U.S. Cl. ..... 108/47; 108/43; 297/194

[58] Field of Search ..... 108/43, 47; 297/194; 211/86

[56] References Cited

U.S. PATENT DOCUMENTS

| | | | |
|---|---|---|---|
| 527,108 | 10/1894 | Cooper | 108/43 X |
| 1,709,927 | 4/1929 | Whitney | 108/132 X |
| 2,501,580 | 3/1950 | Reid | 297/194 X |
| 2,690,942 | 10/1954 | Marcus | 108/132 X |
| 2,787,507 | 4/1957 | Powers | 108/43 |
| 3,185,113 | 5/1965 | Nathan et al. | 297/194 X |
| 3,282,230 | 11/1966 | Levy | 297/194 X |
| 3,709,158 | 7/1973 | Kidd | 108/43 |

FOREIGN PATENT DOCUMENTS

| | | | |
|---|---|---|---|
| 769408 | 3/1957 | United Kingdom | 108/47 |

*Primary Examiner*—James T. McCall
*Attorney, Agent, or Firm*—Howard C. Miskin

[57] ABSTRACT

An upholstered chair arm mountable tray includes a tray member having hinge knuckles depending from opposite side borders, clamp wings having hinge knuckles at its inner corners aligned with the tray knuckles and hinge pins engaging aligned sets of knuckles, each clamp wing being provided with a medially disposed handle defining convex projection open at its outer end. A helical spring surrounds each hinge pin and has end legs engaging the tray member and a clamp wing to bias the clamp wing into superimposition with the underface of the tray member.

6 Claims, 3 Drawing Figures

LAP TRAY

BACKGROUND OF THE INVENTION

The present invention relates generally to improvements in tray devices and it relates more particularly to an improved service tray which may be selectively carried or held in the lap or mounted on a wide or upholstered chair arm.

In the handling and consumption of food and drink under many circumstances and conditions, for example while seated in an upholstered easy chair and viewing television, it is very often convenient to carry the food and drink on a tray so as to being the food and drink in a tray so as to bring the food from the place of preparation to the place of consumption. The tray is commonly supported on the lap of the seated consumer but such practice is highly awkward and as an alternative the tray is placed on a low table adjacent to the seated consumer, and expedient which is not always available and is generally inconvenient. While mountable food trays of various constructions have heretofore been available and proposed they possess numerous drawbacks and disadvantages. They are generally awkward and inconvenient devices which are unreliable and difficult to handle and manipulate, are of little versitility and adaptability and otherwise leave much to be desired.

SUMMARY OF THE INVENTION

It is a principal object of the present invention to provide an improved tray device.

Another object of the present invention is to provide an improved tray device for the conveying and serving of food and drink.

Still another object of the present invention is to provide an improved food tray which may be selectively lap supported or mounted on an upholstered chair or sofa arm.

A further object of the present invention is to provide a tray device of the above nature which is characterized by its reliability, simplicity, ruggedness, ease and convenience of application, attractive appearance and great versitility and adaptability.

The above and other objects of the present invention will become apparent from a reading of the following description taken in conjunction with the accompanying drawings which illustrate a preferred embodiment thereof.

A tray device according to the present invention includes a horizontal tray member a pair of opposite clamp wings hinged to opposite side borders of the tray member and swingable about parallel longitudinal axes between retracted positions superimposed on the tray member under face and depending advanced positions and springs resiliently biasing the clamp wings to their retracted positions.

In accordance with a preferred embodiment of the present invention, the tray member includes a horizontal base and a vertically upwardly offset peripheral border including opposite longitudinally extending parallel side arms from which depend pairs of longitudinally spaced first hinge knuckles. Each clamp wing is of trapezoidal configuration with a pair of second hinge members at its upper corner proximate and in alignment with corresponding first hinge members and a hinge pin engages each set of aligned first and second hinge knuckles. A helical spring encircles the hinge pin and has a first tangential arm at one end bearing on the shoulder between the tray member base and raised border and a second tangential arm at its opposite end engaging a bore in the respective clamp wing to resiliently urge it to its tray underlying retracted position. Integrally formed with each clamp wing is a handle defining outwardly convex shell shaped projection having and outwardly facing access opening.

The improved tray device is simple, rugged and of attractive appearance, easy and convenient to apply, highly reliable and of great versitility and adaptability.

DESCRIPTION OF THE PREFERRED EMBODIMENT

Figure 1:
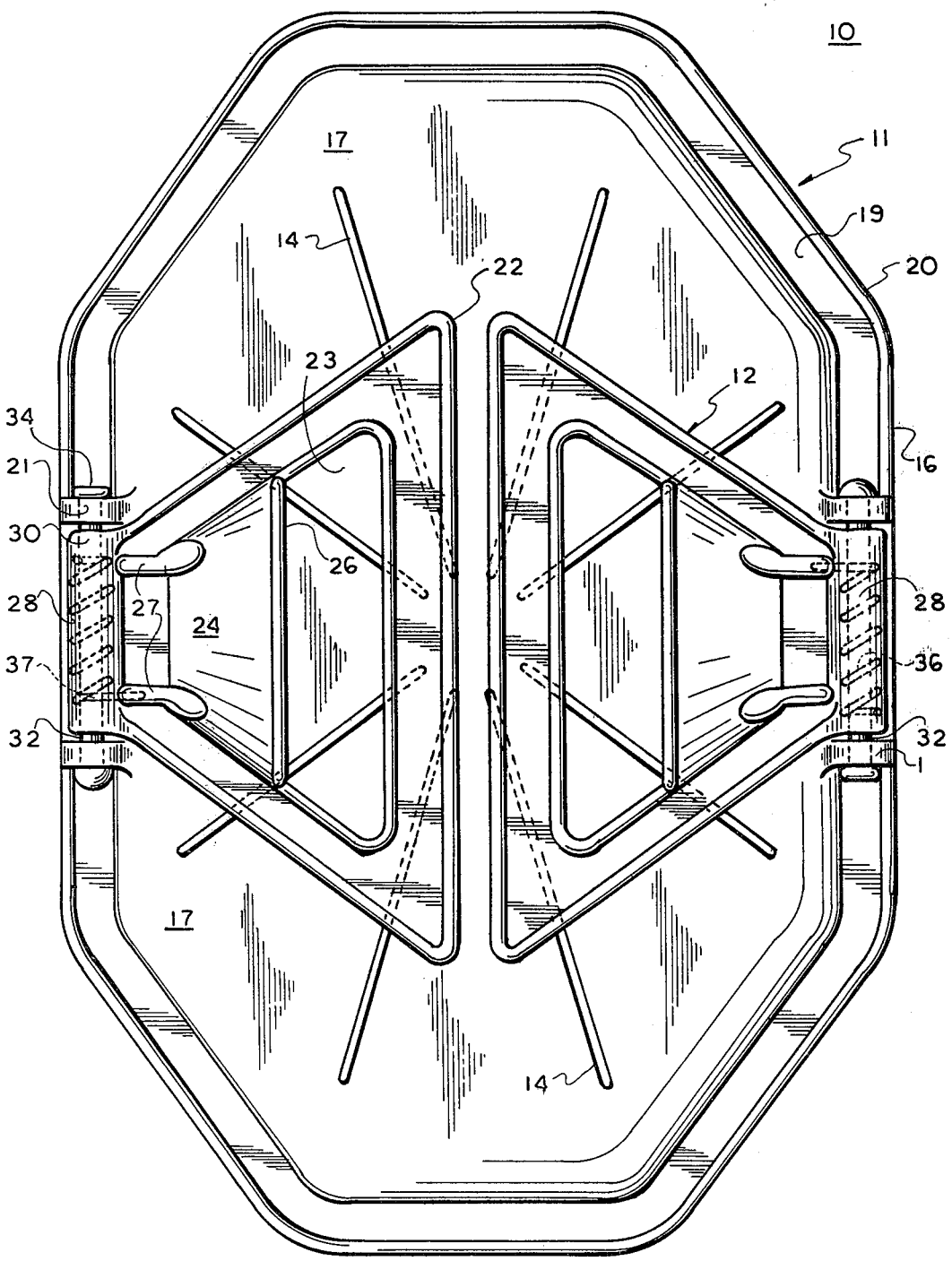
FIG. 1 is a bottom plan view of a tray device embodying the present invention shown in a collapsed clamp retracted condition.

Referring now to the drawings which illustrate a preferred embodiment of the present invention, the reference numeral 10 generally designates the improved tray device which includes a tray member 11 and a pair of clamping wings 12 carried by the tray member 11 for releasably attaching the tray device 10 to the wide or upholstered arm 13 of a chair, sofa or other seat appurtenance.

The tray member 12 is advantageously formed in any suitable manner, such as by injection or transfer molding, of any desirable relatively rigid synthetic organic polymeric resin and while shown as being of octagonal shape with elongated opposite longitudinal side edges 16 it may be of any desired shape and decorated as desired. Tray member 12 includes a flat horizontal octagonal base section 17 reinforced by a plurality of angularly spaced ribs 14 integrally formed with the bottom face of base section 17 and radiating from a central circle on the base section.

Formed along the peripheral edge of and integral with base section 17 is a short upstanding peripheral wall 18 joining an outwardly directed horizontal peripheral flange 19 which terminates in a beaded edge 20. A pair of longitudinally spaced similar, hinge knuckles 21 having coexial bores depend from the flange 18 along each tray member side 16 and are integrally formed with respective adjacent portions of peripheral wall 18 and flange 19.

The clamp wings 12 are of similar shape and construction and each is an integral unit formed of a synthetic organic polymeric resin composition or other suitable material and is of trapezoidal configuration with its larger edge or base 22 at the free end thereof. The base and side edges of each clamp wing 12 are beaded and a trapezoidal opening 23 with its edges parallel to those of the clamp wing 12 is formed in each clamp wing. A handle defining convexly or shell shaped wall 24 of trapezoidal outline projects outwardly from and is integrally formed along its short inner and side edges with the inner short edge and the inner portions of the side edges of opening 23. The free long longitudinal edge 26 of wall 24 is outwardly convex to delineate a handle finger access opening 25 and is beaded as are the free edges of opening 23.

A pair of longitudinally spaced transversely extending parallel ridges or elongated bosses 27 ae formed on the outside face of each clamp wing 12 and extend from the inner edge thereof to the handle wall 24 and each ridge 27 has a longitudinal axial bore extending to and open at the clamp wing inner edge. Integrally formed with and along the inner longitudinal edge of each clamp wing 12 is a longitudinally extending spring housing 28 having a longitudinally extending opening 29 and provided with hinge knuckle defining end walls 30 having aligned bores corresponding to those in hinge knuckles 21.

Each pair of hinge knuckles 30 is positioned between the hinge knuckles 21 of a corresponding pair and a hinge pin 33 engages the aligned bores in each respective set of hinge knuckles to hinge the clamp wings 12 to the tray member 11 to permit the swinging of the clamp wings about parallel longitudinal axes. The hinge pins are provided with enlarged heads at one end and are upset as at 34 at the other ends.

Figure 2:
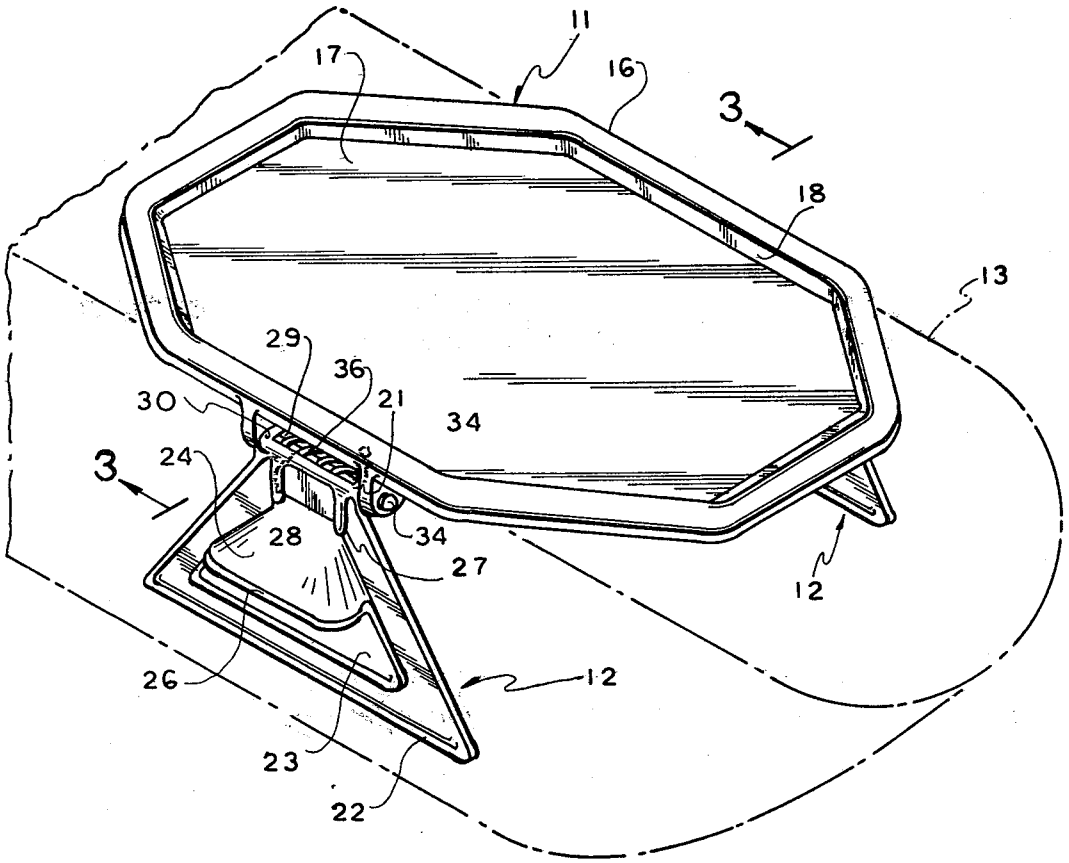
FIG. 2 is a top perspective view thereof shown in a clamp extended chair arm engaging position.
Figure 3:
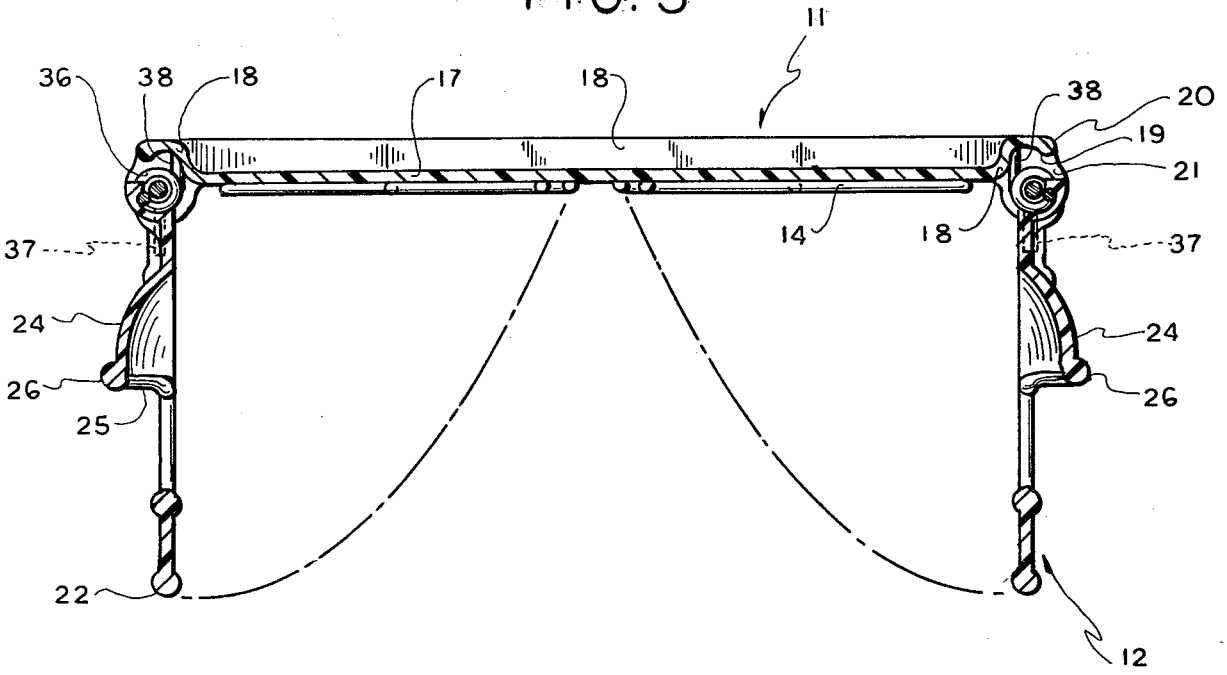
FIG. 3 is a sectional view taken along line 3—3 in FIG. 2.

A helical torsion spring 36 is located in each housing 28 and encircles a respective hinge pin 32. Each spring 36 terminates at one end in a tangentially projecting leg 37 which engages the bore in a respective clamp wing ridge 27 and terminates at its opposite end in a tangentially projecting leg 38 which bears on the adjacent outside face of tray member peripheral wall 18. Each spring 36 is so loaded as to resiliently retain the clamp wings in superimposition with the underface of tray member base 17 while permitting the swinging of clamp wings 12 outwardly to their extended depending positions as shown in FIGS. 2 and 3, with the further loading of springs 36. In the collapsed condition of clamp wings 12, as shown in FIG. 1, with the clamp wings superimposed on the tray member underface, the clamp wing longitudinal free edges 22 are parallel and spaced a short distance apart and the finger openings 25 to handles 24 are easily and conveniently accessable.

In the application of the improved tray member 10, when employed in the conventional manner, the clamp wings are in their collapsed condition and retained therein by springs 36. As shown in FIG. 1 and the tray may be used in the usual manner. When it is desired to support the tray on the upholstered arm 13 of a seat, the handles 24 are grasped by the fingers being inserted through the handle opening and the clamp wings 12 are spread apart against the influence of springs 36. The tray member 11 is then placed on the seat arm 13 and the clamp wings 12 released to close upon and tightly engage the opposite faces of seat arm 13 under the influence of springs 36 to clamp the tray 10 into a firm supported position on seat arm 13. To remove the tray 10 the handles 24 are merely grasped as explained above. The clamp wings 12 spread to release seat arm 13, the tray 10 raised and the clamp arms slowly released to return to their contracted condition. It should be noted that the tray device 10 may be applied to seat arms of various widths and shapes.

While there has been described and illustrated a preferred embodiment of the present invention it is apparent that numerous alterations, omissions and conditions may be made without departing from the spirit thereof.

What is claimed is:

1. A tray device comprising a tray member having opposite longitudinally extending side borders, a pair of longitudinally spaced first hinge knuckles depending from each of said side borders, a pair of clamp wings formed of a synthetic organic polymeric resin and each having integrally formed therewith a handle defining medially disposed convex projection having an access opening at an end thereof, a pair of longitudinally spaced second hinge knuckles formed on the upper edge of each of said clamp wings and aligned with a respective pair of said first hinge knuckles, a hinge pin engaging each set of aligned first and second pairs of hinge knuckles whereby said clamp wings are swingable about respective transversely spaced parallel longitudinal axes proximate said side borders between retracted positions underlying said tray member and depending advanced positions, the transverse dimension of each of said clamp wings being less than one half the distance between said hinge pins and said clamp wings in their retracted positions being superimposed on the underface of said tray member, and spring means biasing said clamp wings to their retracted positions.

2. A tray device comprising a tray member, a pair of clamp wings, means mounting said clamp wings to said tray member for swinging about transversely spaced parallel longitudinal axis between retracted positions underlying said tray member and depending advanced positions and spring means biasing said clamp wings to said retracted positions and wherein said tray member is formed of a synthetic organic polymeric resin and includes a horizontal base and a vertically upwardly offset horizontal peripheral border, each of said clamp wings is formed of a synthetic organic polymeric resin and is of trapezoidal configuration and has a handle defining outwardly convex shell shaped projection medially formed on its outer face, said mounting means includes a pair of longitudinally spaced first hinge knuckles depending from each tray member side border and a pair of longitudinally spaced second hinge knuckles formed at the upper corners of each clamp wing and disposed between and aligned with a respective pair of first hinge knuckles and a hinge pin engaging each aligned set of first and second knuckles and said spring means comprises a helical spring surrounding each of said hinge pins and having opposite tangential legs engaging said tray member and a clamp wing respectively.

3. The tray device of claim 1 wherein each of said clamp wings is of trapezoidal configuration with said second hinge knuckles being integrally formed at the upper corners thereof.

4. The tray device of claim 1 wherein said tray member is formed of a synthetic organic polymeric resin and has a raised peripheral border, said first hinged knuckles being integrally formed with and depending from said raised border.

5. The tray device of claim 1 wherein said spring means includes a helical spring registering with said hinge pin between each pair of second hinge knuckles and having a tangential first end leg engaging a bore in a corresponding clamp wing and an opposite tangential second leg engaging a face of said tray member.

6. The tray device of claim 2 wherein each of said handles is medially formed between the inner and outer ends of a respective wing clamp has an access opening in an outwardly directed end thereof.

* * * * *